US005957722A

United States Patent [19]

Pan et al.

[11] Patent Number: 5,957,722

[45] Date of Patent: Sep. 28, 1999

[54] LOCKING DEVICE FOR AN ELECTRICAL CONNECTOR

[75] Inventors: Hua-Tseng Pan, Taipei; Chi-Kuang Tuan, Taipei Hsien, both of Taiwan

[73] Assignee: Hon Hai Precision Ind. Co., Ltd., Taipei Hsein, Taiwan

[21] Appl. No.: 08/921,630

[22] Filed: Aug. 27, 1997

[51] Int. Cl.[6] ..... H01R 13/73

[52] U.S. Cl. ..... 439/567

[58] Field of Search ..... 439/567, 569–572

[56] References Cited

U.S. PATENT DOCUMENTS

| | | | |
|---|---|---|---|
| 4,681,389 | 7/1987 | Nakazawa et al. | 439/567 |
| 5,393,247 | 2/1995 | DiOrazio et al. | 439/567 |
| 5,632,649 | 5/1997 | Spangler | 439/567 |

*Primary Examiner*—Gary Paumen

[57] ABSTRACT

A locking device for an electrical connector is disclosed. The locking device comprises a main plate body defining two first edges and a second edge, a fixing section extending from each of the first edge of the main plate body for fixing into the electrical connector and a boardlock section for locking into a locking hole of a circuit board. The boardlock section includes two resilient arms extending downward from the second edge of the main plate body and defining a gap between the two resilient arms for inward bending thereof, each of the resilient arms having an outer edge defining a curved retention portion, a vertical straight detent portion extending downward from the retention portion, an inward slant pressing portion extending downward from the detent portion at a first slope, and an inward slant guiding portion extending downward from the pressing portion at a second slope larger than the first slope.

18 Claims, 6 Drawing Sheets

99

LOCKING DEVICE FOR AN ELECTRICAL CONNECTOR

BACKGROUND OF THE INVENTION

1. Field of the Invention

The invention relates to a locking device for an electrical connector.

2. The Prior Art

Locking devices are used frequently in electrical connectors for facilitating fastening connectors to a circuit board and some of them are disclosed in, for example, Taiwan Patent Application Nos. 80202099, 80207178, 81207106, 82204413, 82206344, 82216079, 83207936 and 84101384. With conventional locking devices, interference occurs at the beginning of insertion into a hole of a circuit board, and a relatively large force must be exerted on the connector possessing these locking devices at the very beginning. However, usually the conductive contacts received in the connector do not reach or align with the corresponding receiving holes in the circuit board, which causes bending or buckling or misalignment of contacts. In addition, the point portion of the locking device scratches the inner surface of the receiving holes. Furthermore, the buoyancy generated by the molten solder during wave-soldering procedure lifts the connector and, in turn, the locking devices, which results in point contact between the point portion of the locking device and the inner wall of the receiving hole, and thus does not provide locking force enough to retain the connector on the circuit board.

Hence, there is a need for a locking device for an electrical connector that can overcome the above-mentioned problems and shortcomings.

SUMMARY OF THE INVENTION

Accordingly, one object of the present invention is to provide a locking device for an electrical connector, which does not interfere with a locking hole in the circuit board at the beginning of insertion.

Another object of the present invention is to provide a locking device for an electrical connector which effectively locks in a locking hole of a circuit board during wave-soldering procedure.

Another object of the present invention is to provide a locking device for an electrical connector which will not damage the locking hole of the circuit board.

To fulfill the above-mentioned objects, according to one embodiment of the present invention, a locking device for an electrical connector comprises a main plate body defining two first edges and a second edge, a fixing section extending from each of the first edges of the main plate body for fixing into the electrical connector and a boardlock section for locking into a hole of a circuit board. The boardlock section includes two resilient arms extending downward from the second edge of the main plate body and defining a gap between the two resilient arms for inward bending thereof, each of the resilient arms having an outer edge defining a curved retention portion, a vertical straight detent portion extending downward from the retention portion, an inward slant pressing portion extending downward from the detent portion at a first slope, and an inward slant guiding portion extending downward from the pressing portion at a second slope larger than the first slope.

In one aspect, the main plate body of the locking device is vertical plate defining a plane on which the resilient arms of the boardlock section extend.

In the other aspect, the main plate body of the locking device is a horizontal plate defining a plane on which the resilient arms of the boardlock section extend.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 2:
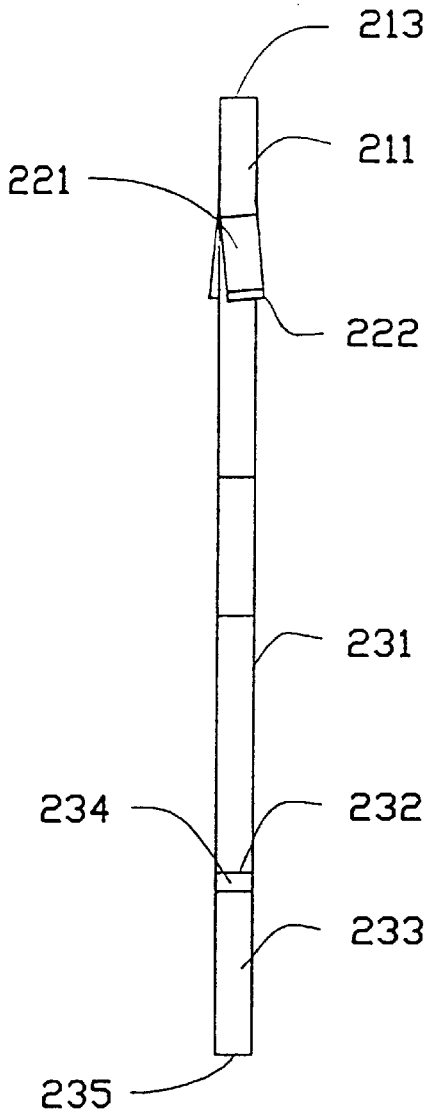
FIG. 2 is a side elevational view of the locking device shown in FIG. 1.

Reference will now be made in detail to the preferred embodiments of the present invention. It will be noted here that for a better understanding, most of like components are designated by like reference numerals throughout the various figures in the embodiments.

Figure 1:
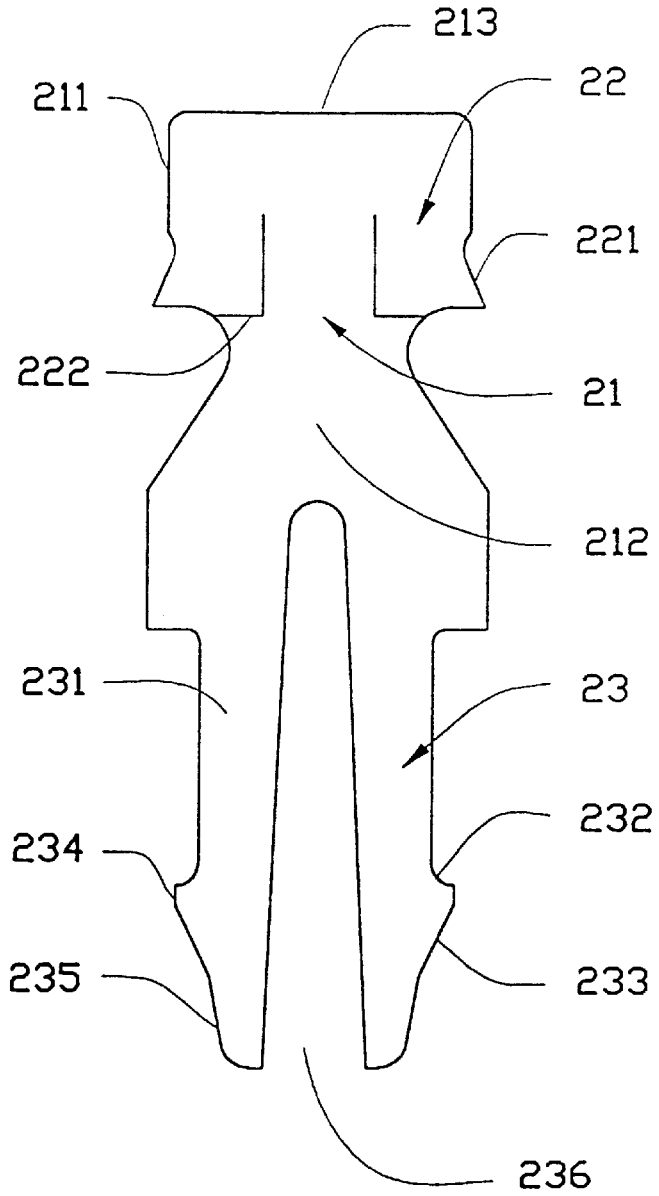
FIG. 1 is a front elevational view of a locking device for a connector according to one embodiment of the present invention.
Figure 3:
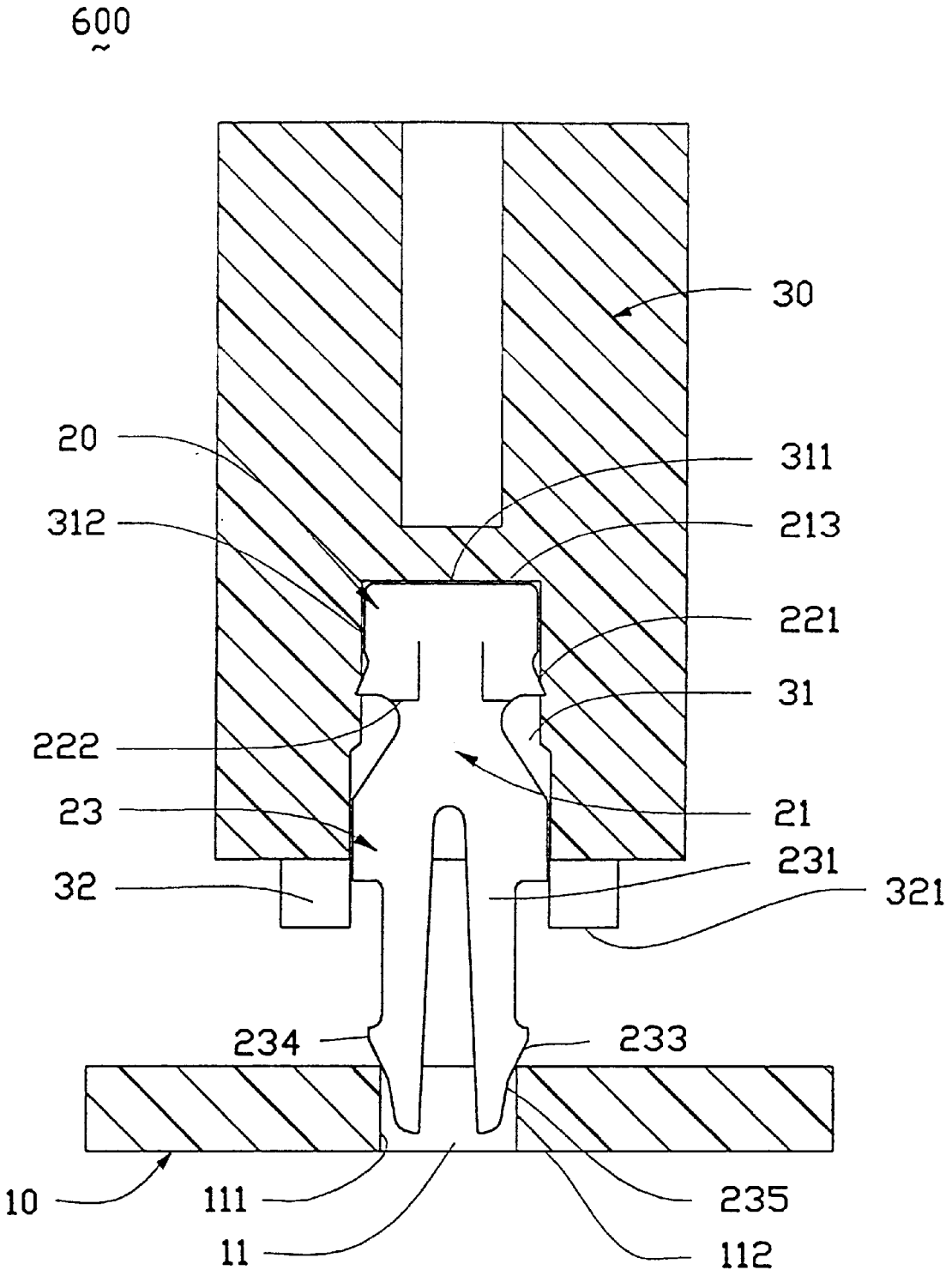
FIG. 3 is a cross-sectional view of the locking device shown in FIG. 1 received in a connector, in which the guiding portions of the locking device are inserted in a hole in a circuit board.

Referring now to FIGS. 1 and 2, a locking device for an electrical connector according to a preferred embodiment of the present invention is generally designated at 20. The locking device 20 is integrally formed of a metal plate and comprises a main body 21, fixing sections 22 formed on two lateral sides of the main body 21, and a boardlock section 23 extending downward of the main body 21. In the present preferred embodiment, the main body 21 includes a vertical plate defining two first lateral edges 211, a second lower edge 212, and a third upper edge 213 as a stopper. Each of the fixing sections 22 is integrally stamped out of a lateral portion of the main body 21 and includes an outer barb 221 extending outward and an inner barb 222 deflecting out of a plane defined by the main body 21 for fixing the locking device 20 into an insulating housing 30, as shown in FIG. 3. The boardlock section 23 includes two resilient arms 231 extending downward from the lower edge 212 of the main body 21 and defines a narrow gap 236 therebetween.

Each of the resilient arms 231 comprises continuously on an outer edge from a top to a bottom thereof a relatively long vertical straight edge, a retention portion 232 including a curved edge continuously extending outward from the vertical straight edge, a detent portion 234 including a short vertical straight edge continuously extending downward from the curved edge, a pressing portion 233 including a slant edge continuously extending inward from the detent portion 234 in a first small slope, and a guiding portion 235 includes a slant upper edge continuously extending inward therefrom with a second large slope and a chamfered lower end edge continuously extending from the slant upper edge. Therefore, the boardlock section 23 has a tapered lower end formed by the guiding portions 235, a wider middle portion formed by the pressing portions 233, the detent portions 234 and the retention portions 232, and a vertical upper portion formed by straight outer edges of the arms 231.

Figure 4:
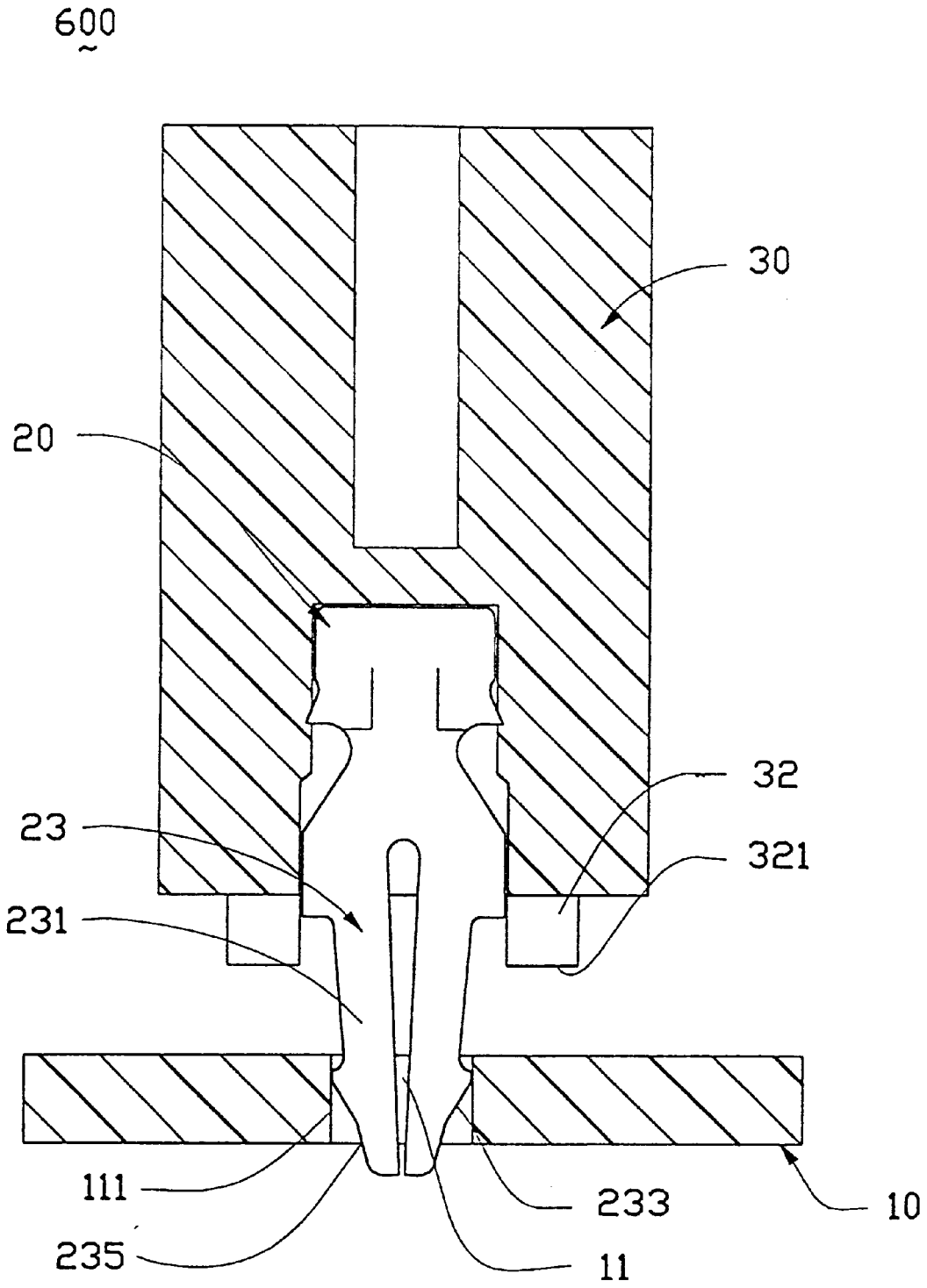
FIG. 4 is a cross-sectional view of the locking device shown in FIG. 1 received in a connector, in which the pressing portions of the locking device are inserted in the hole in a circuit board.
Figure 5:
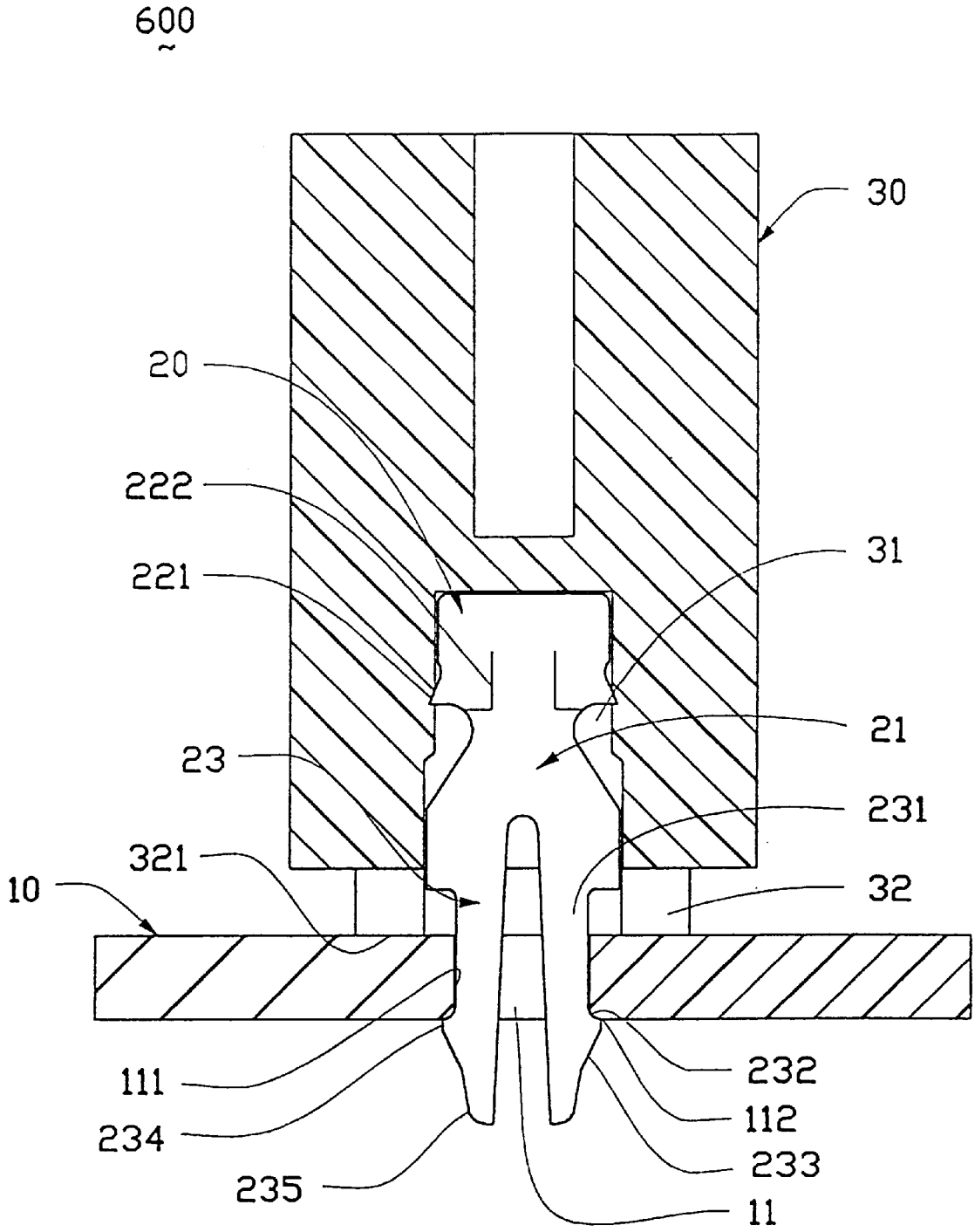
FIG. 5 is a cross-sectional view of the locking device shown in FIG. 1 received in a connector, in which the locking device is completely inserted in a hole in a circuit board.

Please now refer to FIGS. 3 through 5, wherein the locking device 20 is fixed in the housing 30 of a connector 600 by the fixing sections 22 and continuously inserted at its boardlock section 23 into a locking hole 11 of a circuit board 10. At a first phase of the insertion, as shown in FIG. 3, the guiding portions 235 of the locking device 20 are inserted into the locking hole 11 without interference therebetween since the guiding portions 235 form a tapered end with a maximum width smaller than the diameter of the locking hole 11. The arms 231 will not deform since no external force is exerted on the guiding portions 235. The connector 600 can be "pre-mounted" onto the circuit board 10 with the guiding of the guiding portions 235 into the locking hole 11 so that the conductive contacts (not shown) of the connector 600 align the corresponding holes (not shown) on the circuit board 10.

Next, at a second phase of the insertion, the locking device 20 is inserted deeper into the locking hole 11 and the pressing portions 233 which constitute a width of the locking device 20 larger than the diameter of the locking hole 11, are pressed inward by an upper rim portion of the locking hole 11 so that the arms 231 bend toward each other. When the locking device 20 is inserted further deeper with the arms 231 bending further toward each other, the outermost portions of the arms 231, i.e., the detent portions 234 are pushed into the locking hole 11, and tightly abut to and slide along an inner wall 111 of the locking hole 11, as shown in FIG. 4.

Finally, at a third stage of the insertion, the boardlock section 23 of the locking device 20 is completely inserted in the locking hole 11 of the circuit board 10 and standoffs 32 of the connector 600 abut an upper surface of the circuit board 10. The guiding portions 235, the pressing portions 233 and the detent portions 234 all pass through the locking hole 11 and the arms 231 stretch outward with the retention portions 232 urging against a lower rim portion of the locking hole 11 and the vertical straight edges of the arms 231 pushing against the inner wall 111 of the locking hole 11.

In one embodiment, the retention portion 232 may include a 90 degree concave arc for effectively engage with the lower rim portion of the locking hole 11. In another embodiment, the retention portion 232 may further comprise a horizontal portion extending from an end of the concave arc to joint the vertical straight detent portion 234.

In a situation that the thickness of the circuit board 10 is larger than the height between the retention portion 232 and a bottom 321 of the standoffs 32 formed on bottom of the connector housing 30 so that the detent portions 234 do not pass through the locking hole 11, the connector 600 is fastened onto the circuit board 10 by the interfering engagement between the detent portions 234 and the inner wall 111 of the locking hole 11.

Figure 6:
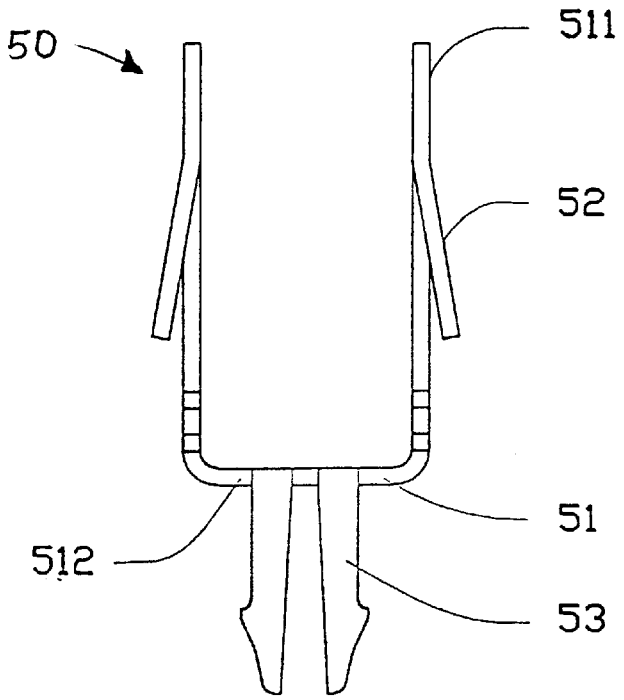
FIG. 6 is a front elevational view of a locking device for a connector according to another embodiment of the present invention.
Figure 7:
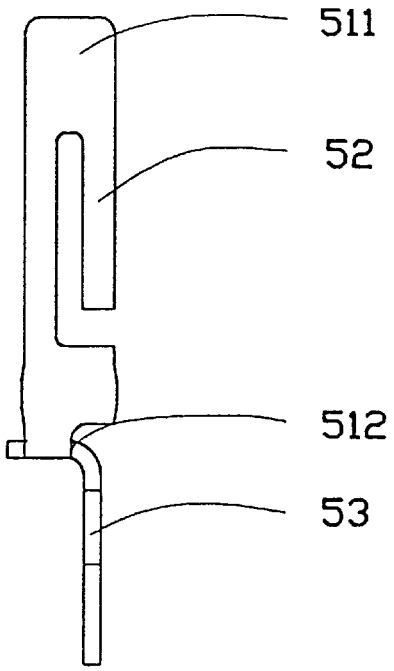
FIG. 7 is a side elevational view of the locking device shown in FIG. 6.

FIGS. 6 and 7 show a locking device 50 for an electrical connector 99 (FIG. 8) according to a second embodiment the present invention. The locking device 50 is integrally formed of a metal plate and comprises a main body 51, fixing sections 52 formed on two lateral sides of the main body 51, and a boardlock section 53 extending downward of the main body 51.

In the present preferred embodiment, the boardlock section 53 is similar to that of the first embodiment, locking device 20, of the present invention and includes two resilient arms extending downward from a lower front edge of the main body 51 and defines a narrow gap between the two resilient arms. The arms of boardlock section 53 include on an outer edge thereof, from top to bottom, a vertical straight portion, a curved retention portion, an outward protruding vertical straight detent portion, a pressing portion and a guiding portion, substantially the same as those of the arms 231 of the boardlock section 23.

Figure 8:
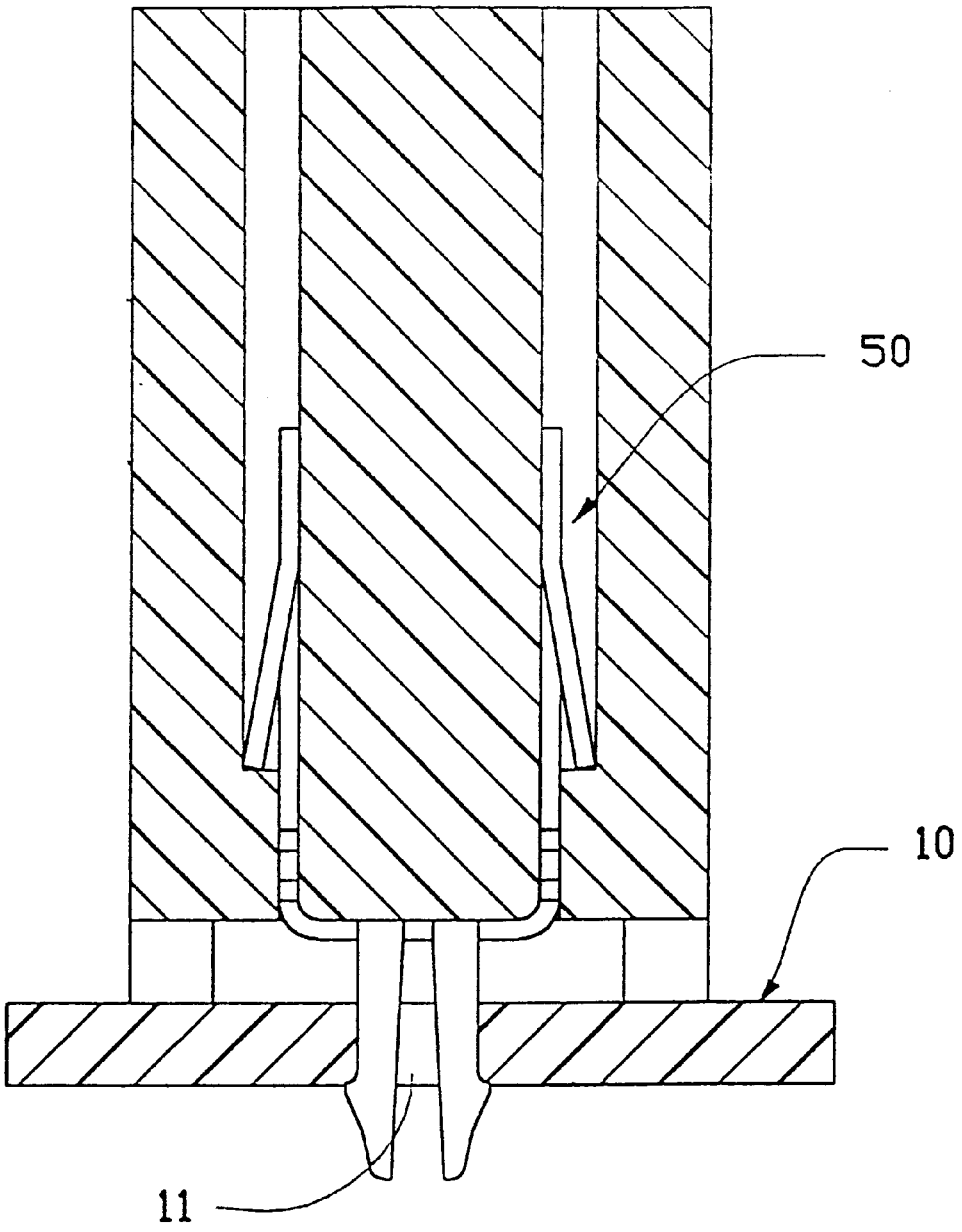
FIG. 8 is a cross-sectional view of the locking device shown in FIG. 6 received in a connector, in which the locking device is completely inserted in a hole in a circuit board.

The main body 51 includes a horizontal central plate defining a front edge 512, and a pair of upward bending lateral plates 511 extending from two opposite ends thereof. An outward slant piece is stamped out of each of the lateral plates 511 and bending out of a vertical plane defined by the lateral plate 511 as the fixing section 52 for fixing to a housing of the connector 99, as can be seen in FIG. 8. FIG. 8 also shows the mounting of the connector 99 on the circuit board 10 by insertion of the boardlock section 53 into the locking hole 11 of the circuit board 10.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A locking device for an electrical connector, comprising:

a main plate body defining two first edges and a second edge;

a fixing section extending from each of said first edges of the main plate body for fixing into the electrical connector;

a boardlock section for locking into a locking hole of a circuit board, including two resilient arms extending downward from said second edge of the main plate body and defining a gap between the two resilient arms for inward bending thereof, each of said resilient arms having an outer edge defining an outwardly extending curved retention portion, an inwardly slanted pressing portion extending downward from the retention portion at a first slope, an inwardly slanted guiding portion extending downward from the pressing portion at a second slope larger than the first slope.

2. The locking device for an electrical connector as claimed in claim 1, wherein said main plate body is a vertical plate defining a plane from which the resilient arms of the boardlock section extend.

3. The locking device for an electrical connector as claimed in claim 2, wherein each said fixing section includes an outer barb extending outward and an inner barb deflecting out of the plane defined by the main plate body.

4. The locking device for an electrical connector as claimed in claim 1, wherein each said resilient arm of the boardlock section further comprises a vertical straight detent portion extending between the retention portion and the pressing portion.

5. The locking device for an electrical connector as claimed in claim 4, wherein said retention portion includes a 90 degree concave arc.

6. The locking device for an electrical connector as claimed in claim 5, wherein said retention portion further comprises a horizontal portion extending from an end of said concave arc to said straight detent portion.

7. The locking device for an electrical connector as claimed in claim 1, wherein said guiding portion of the resilient arm comprises a slanted upper edge continuously extending from the pressing portion with the second larger slope and a chamfered lower end edge continuously extending from said slanted upper edge.

8. The locking device for an electrical connector as claimed in claim 1, wherein said main plate body is a horizontal plate defining a plane on which the resilient arms of the boardlock section extend.

9. The locking device for an electrical connector as claimed in claim 8, wherein said main plate body includes a pair of upward bending lateral plates extending from two opposite ends thereof.

10. The locking device for an electrical connector as claimed in claim 9, wherein said each of the lateral plates comprises an outward slant piece stamped out therefrom and bending out of a vertical plane defined by the lateral plate as the fixing section.

11. The locking device for an electrical connector as claimed in claim 8, wherein said resilient arm of the boardlock section further comprises a vertical straight detent portion extending between the retention portion and the pressing section.

12. The locking device for an electrical connector as claimed in claim 11, wherein said retention portion includes a 90 degree concave arc.

13. A locking device for an electrical connector comprising:

a main body defining a first end and a second end;

a fixing section extending from said first end of the main body for fixing into the electrical connector;

a boardlock section extending from said second end of the main body for locking into a locking hole of a circuit board, said boardlock section including two resilient arms defining a gap therebetween for inward bending, each of said resilient arms having an outer edge defining an upward inward curved retention portion, a downward inward slant pressing portion, and a straight detent portion therebetween;

wherein said main body includes a vertical plate defining a plane from which the resilient arms of the boardlock section extend; and wherein said fixing section includes an outer barb extending outward and an inner barb extending out of the plane defined by the main body.

14. The locking device for an electrical connector as claimed in claim 13, wherein said main body includes fixing means stamped out of each of a pair of upward bending lateral plates extending from two opposite ends of said main body.

15. A locking device for an electrical connector comprising:

a main body defining a first end and a second end;

a fixing section extending from said first end of the main body for fixing into the electrical connector;

a boardlock section extending from said second end of the main body for locking into a locking hole of a circuit board, said boardlock section including two resilient arms defining a gap therebetween for inward bending, each of said resilient arms having an inward slant pressing portion extending downward at a first slope and an inward slant guiding portion extending downward from said pressing portion at a second slope larger than said first slope.

16. The locking device for an electrical connector as claimed in claim 15, wherein said main body includes a vertical plate defining a plane on which the resilient arms of the boardlock section extend.

17. The locking device for an electrical connector as claimed in claim 16, wherein said fixing section includes an outer barb extending outward and an inner barb deflecting out of the plane defined by the main body.

18. The locking device for an electrical connector as claimed in claim 15, wherein said main body includes fixing means stamped out of each of a pair of upward bending lateral plates extending from two opposite ends of said main body.

* * * * *